United States Patent [19]

Kolt

[11] 4,123,001

[45] Oct. 31, 1978

[54] AUTOMATIC VENTILATOR

[75] Inventor: Stanley Kolt, Mamaroneck, N.Y.

[73] Assignee: Leonard W. Suroff, Jericho, N.Y. ; a part interest

[21] Appl. No.: 832,482

[22] Filed: Sep. 12, 1977

[51] Int. Cl.[2] ..... F24F 11/02

[52] U.S. Cl. ..... 236/49; 98/43 C; 98/72

[58] Field of Search ..... 98/21, 42 R, 43 C, 41 R, 98/72; 236/49; 60/530, 531; 251/11; 236/93, 93A

[56] References Cited

U.S. PATENT DOCUMENTS

| | | | |
|---|---|---|---|
| 1,737,054 | 11/1929 | McQuistan | 236/49 |
| 1,888,428 | 11/1932 | Martin | 98/42 |
| 2,403,291 | 7/1946 | Kurth | 236/49 X |
| 2,552,735 | 5/1951 | Rawson | 236/49 |
| 3,777,974 | 12/1973 | Sparks | 236/49 |
| 3,921,900 | 11/1975 | Cole | 236/93 |
| 3,976,245 | 8/1976 | Cole | 236/93 A |
| 4,061,266 | 12/1977 | Ley et al. | 236/49 |

FOREIGN PATENT DOCUMENTS

| | | | |
|---|---|---|---|
| 11,854 of | 1906 | United Kingdom | 98/21 |

*Primary Examiner*—George H. Krizmanich
*Attorney, Agent, or Firm*—Leonard W. Suroff

[57] ABSTRACT

An automatic temperature responsive damper assembly for use within the conduit of a ventilating system designed to exhaust the air in a confined space to the atmosphere whereby the conduit may be opened in order to minimize excess heat build-up in the confined space and closed when it is desired to prevent heat loss from the confined space. The damper assembly includes at least one vane carried within the conduit, preferably two, with mounting means operatively associated with the conduit for pivotally securing the at least one vane thereto, so as to be movable between a generally open position and a generally closed position in the conduit to permit the passage of air therethrough in its open position. Camming means is secured to the at least one vane carried by the mounting means and includes a camming surface thereon with a temperature responsive drive assembly mounted to detect temperature changes in the conduit and adapted to actuate in response to temperature changes within a predetermined range. Transmission means couples the drive assembly to the camming means for communicating movement of the drive assembly to the camming means, such that the at least one vane is moved to varying positions in response to temperature changes in the ventilating conduit. Biasing means is provided for urging the camming means into contact with the transmission means in a direction opposite to the forces applied by the drive assembly, so as to obtain an automatic closing of the at least one vane irrespective of the mounted position of the conduit.

35 Claims, 8 Drawing Figures

FIG. 1
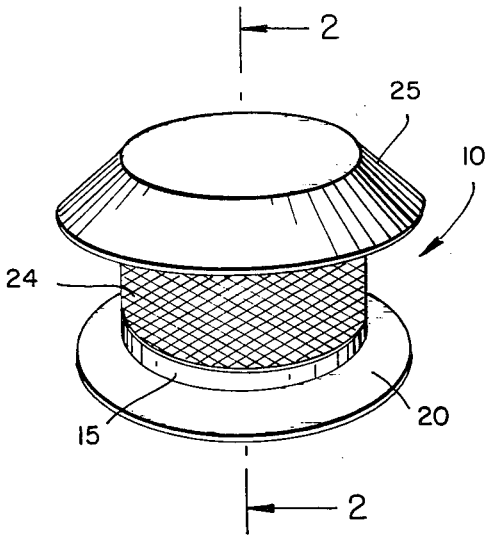
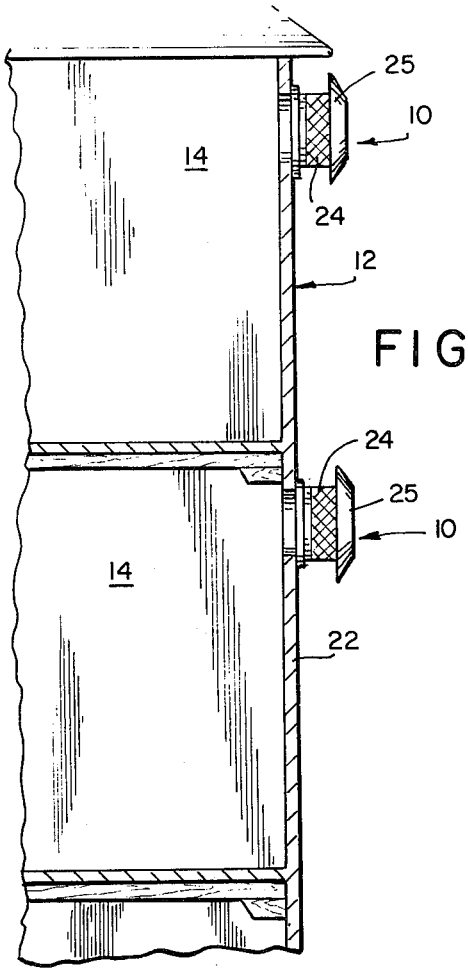
FIG. 6
FIG. 2
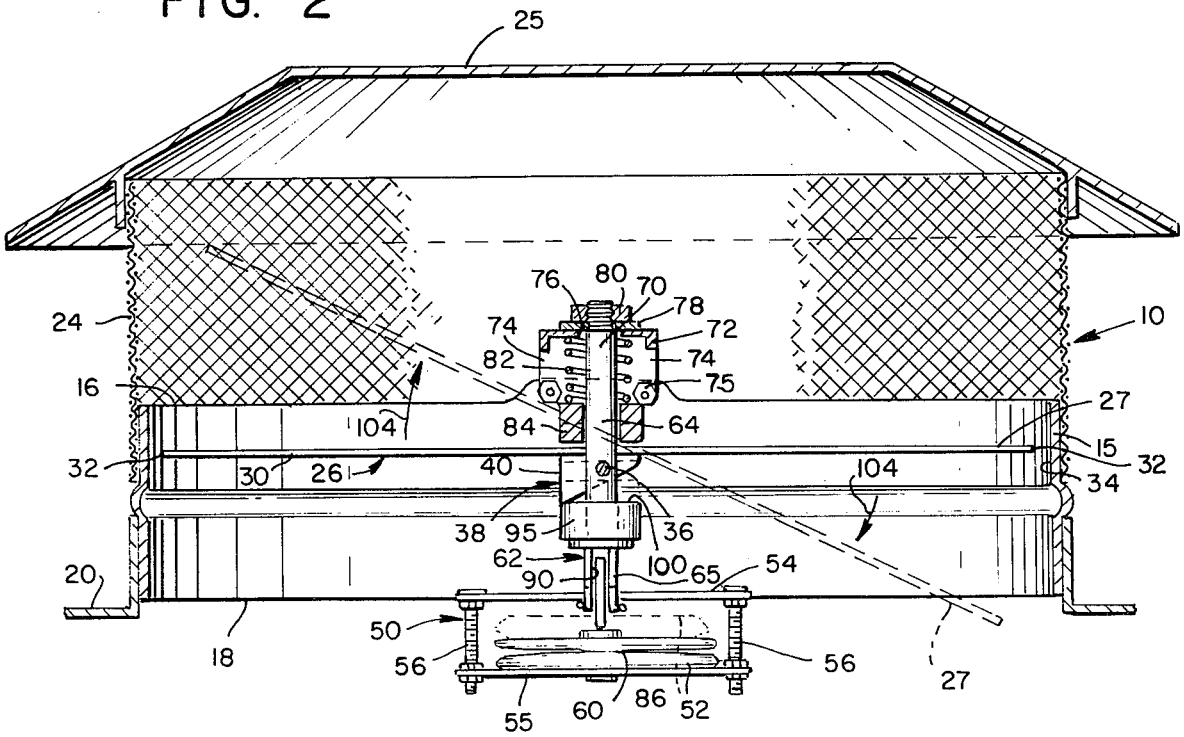

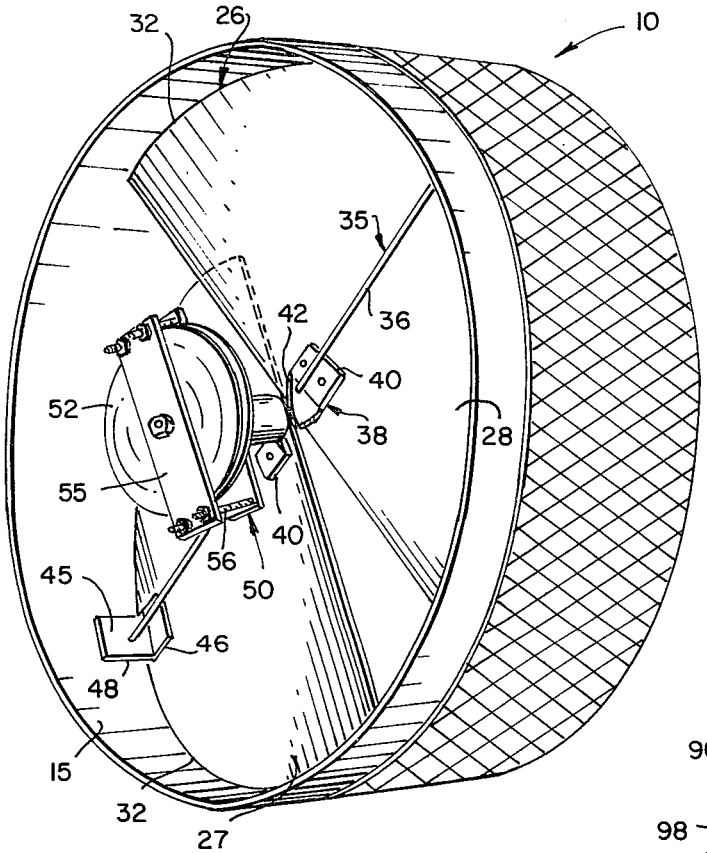
FIG. 3
FIG. 5
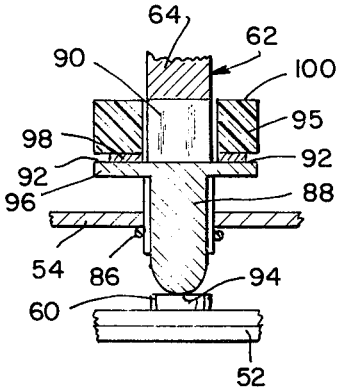
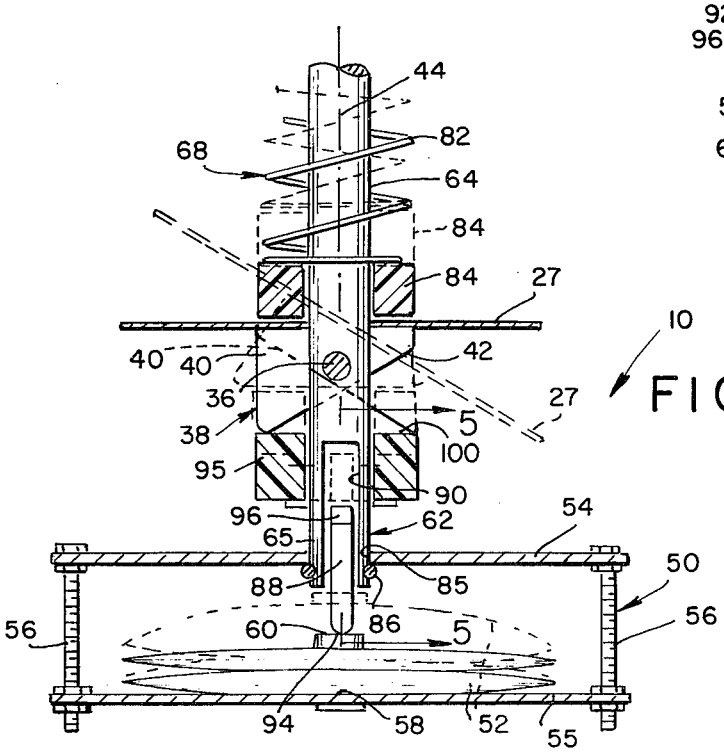
FIG. 4

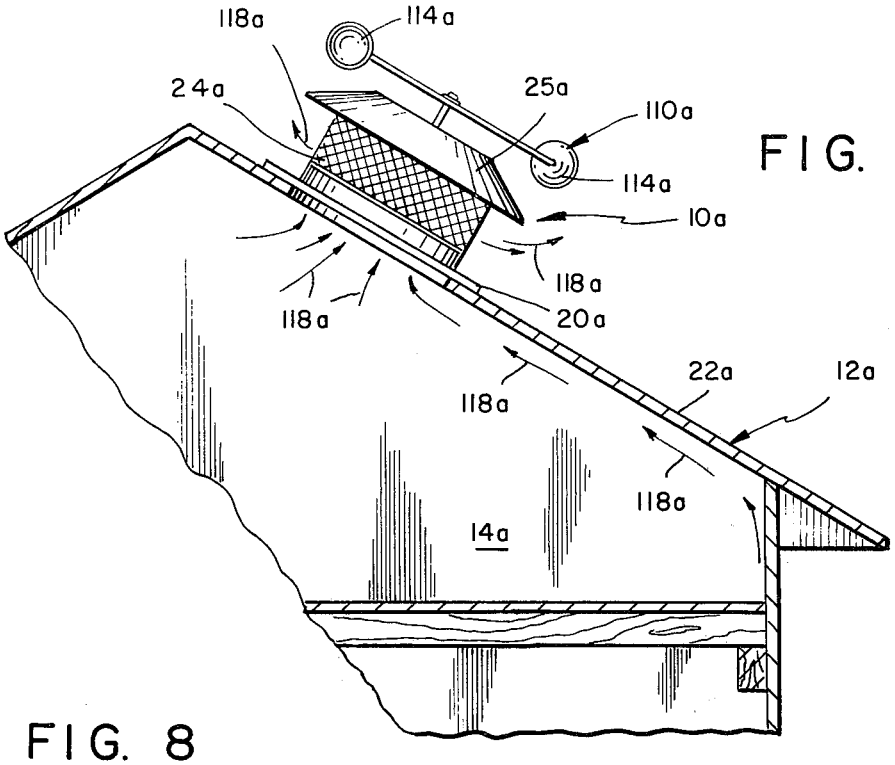
FIG. 7
FIG. 8
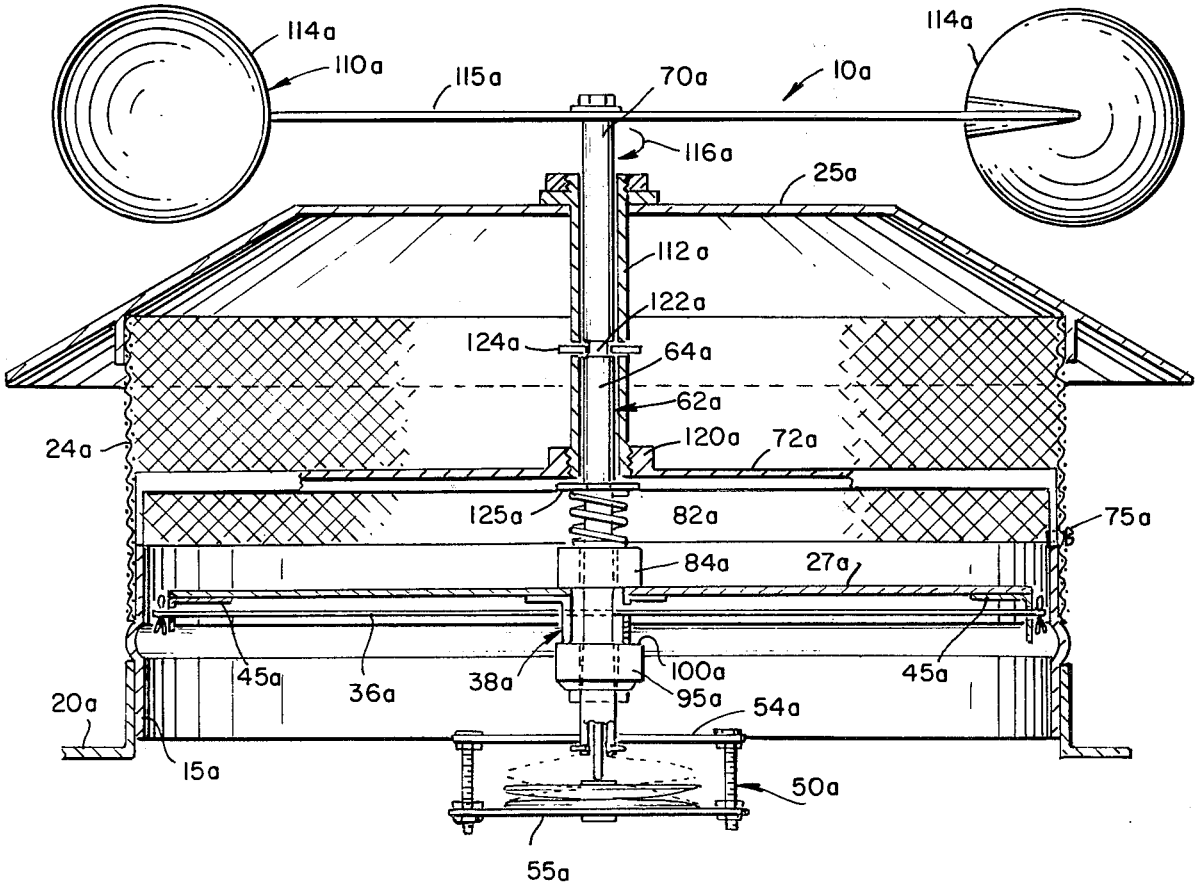

AUTOMATIC VENTILATOR

BACKGROUND OF THE INVENTION

1. Field of the Invention

The present invention is directed generally to a ventilation conduit damper assembly for use in a variety of angular mounted positions. More specifically, the present invention is directed to such a ventilation damper assembly provided with automatic, temperature responsive, actuating means whereby the amount of movement of the damper vanes, over a preselected temperature range, is controlled and will automatically close whether mounted in a vertical or horizontal plane.

2. Description of the Prior Art

Dampers for use in air conduits or ducts are generally well known and typically a damper assembly will consist of a moveable vane or vanes which are positionable to control the amount of air flow through the conduit within which the damper is placed. Dampers are additionally often used in conjunction with the ventilating systems in private homes and other buildings where it is desired to provide a measure of ventilation control.

In some areas of the country where rather hot weather is experienced during at least a portion of the year, it is often desirable to provide a means for ventilating an otherwise confined portion of a building, for example, the attic in a private home, in order to minimize the buildup therein of excessive heat and/or humidity. This ventilation is often provided by the use of a turbine air ventilator of a known type in which wind causes the turbine blades to rotate, producing in effect a pumping action, assisting the air flow out of the area provided with the ventilating conduit.

While turbine ventilation systems are quite effective in promoting air flow, they have, in the past, suffered from the lack of an effective automatic means to control the amount of air removed. Obviously the air flow should be at a maximum during hot weather when the temperature in the area to be ventilated is high, but just as obviously the ventilation should be much less when the temperature in the area to be ventilated is lower. Unnecessary ventilation in periods of cool temperatures may contribute to excessive loss of heat and consequent increase in heating costs. While this problem of present ventilation systems is recognized, the attempted solutions have been less than satisfactory.

Since the space to be ventilated, typically an attic, is often inaccessible, the homeowner requires an automatic damper for efficient ventilation in hot periods or for retention of heated air during cold periods. With the increasing cost of power used for heating and air conditioning, it becomes readily apparent why an automatic damper system should be utilized in conjunction with ventilation systems.

Unfortunately, the prior automatic adjustable dampers which have been contemplated or manufactured as for example disclosed in U.S. Pat. Nos. 1,737,054; 3,921,900 and 3,976,245 and have been unable, under certain conditions of positionment, to perform their desired function in an effective manner, in that the angle in which they operate is limited. There are numerous applications in which it would be desirable to mount the damper on a horizontal plane rather than on a roof per se. The dampers or ventilators described in the prior art patents do not readily lend themselves to this mounting arrangement.

OBJECTS OF THE INVENTION

An object of the present invention is to provide an automatic damper assembly for use in home and industrial ventilating systems.

Another object of the present invention is to provide an automatic damper which requires no attention from the homeowner and which may be mounted in a vertical or horizontal plane.

Another object of the present invention is to provide an automatic damper assembly which has at least one vane damper positioned in an air flow conduit, and which vane is automatically forced into a closed position whether mounted in a vertical plane, horizontal plane, or an angle therebetween.

Other objects and advantages of the present invention will become apparent as the disclosure proceeds.

SUMMARY OF THE INVENTION

An automatic temperature responsive damper assembly for use within the conduit of a ventilating system designed to exhaust the air in a confined space to the atmosphere whereby the conduit may be opened in order to minimize excess heat build up in the confined space and closed when it is desired to prevent heat loss from the confined space. The assembly includes at least one vane carried within the conduit, preferably two, with mounting means operatively associated with the conduit for pivotally securing the at least one vane thereto, so as to be movable between a generally open position and a generally closed position in the conduit to permit the passage of air therethrough in its open position.

Camming means is secured to at least one vane carried by the mounting means and includes a camming surface thereon. A temperature responsive drive assembly is mounted to detect temperature changes in the conduit and adapted to actuate in response to temperature changes within a predetermined range. Transmission means operatively extends between the drive assembly and the camming surface of the camming means for communicating movement of the drive assembly to the camming means, such that the at least one vane is moved to varying positions in response to temperature changes in the ventilating conduit.

Biasing means is provided for urging the camming means into contact with the transmission means in a direction opposite to the forces applied by the drive assembly, so as to obtain an automatic closing of the at least one vane irrespective of the mounted position of the conduit. This overcomes the drawbacks of the prior art in which the vanes could possibly "stick" in their open position.

The biasing means may include a bracket member mounted in fixed relation to the transmission means on the side of the vane opposite to the drive assembly, and a spring mounted in telescopic relationship to the transmission means intermediate the bracket member and the vane, such that the spring normally urges the vane to remain in its closed position. This arrangement assures the homeowner or industrial user that the damper assembly will always automatically close irrespective of its mounted position.

The transmission means may be rotatably mounted with respect to the conduit such that turbine means can be mounted on the transmission means at one end thereof and adapted to be rotated by wind power. This provides without any electrical power, a suction type force to be transmitted from the vane or vanes utilized as they are inclined relative to each other and caused to rotate by wind forces exteriorly of the building on which the damper is mounted.

As previously discussed, since it is desirable to provide ventilation for enclosed spaced such as buildings or attics during at least a portion of the year, a damper that can be used as a turbine ventilator, provides ventilation and additionally, and more importantly, provides an automatic control such that air flow is controllable in response to ambient air temperatures. This insures that adequate ventilation is provided when necessary, yet prevents the unwanted flow of air when the ambient temperature is below a preset level. Thus, heating costs are reduced since the system is closed during cold weather.

Because the totality of the damper assembly is contained within the air conduit, it is a feature of the present invention that the damper is mountable in an existing duct line with no additional exterior space required. This feature is of particular benefit in areas where the exterior of the damper assembly is readily noticeable and homeowners would prefer not to call their attention thereto.

Due to the completely automatic nature of the present damper assembly, no attention is required on the part of the homeowner. The damper operates automatically over the preselected temperature range, opening and closing in response to temperature changes, thus assuring even the most foregetful homeowner that proper ventilation is taking place. The apparatus of the present invention may be positioned at the most advantageous portion of the flow conduit with no necessity for concerning oneself if it is to be vertically or horizontally mounted in position.

The preferred temperature-sensitive bellows power unit which causes the movement of the transmission means to effect opening and closing of the damper is of well known design. One feature of these units is that they can be manufactured to operate over a number of desirable temperature ranges. A bellows unit with the desired temperature-sensitivity is chosen and installed in the assembly to cause the damper to open and close over the desired range. Abnormally low temperatures will not adversely affect the performance of such a power unit since one the temperature falls below the range of the bellows, further temperature decreases will have no effect. Abnormally high temperatures, on the other hand, do cause the bellows unit to continue to expand to some degree.

However, with the preferred embodiment, this will not harm the damper mechanism of the present invention. The camming surfaces on the camming means are so shaped as to slide over the surface of the transmission means and the closing of the vanes is aided by the biasing means which urges the vanes into their closed position. Hence, the present damper assembly, unlike previously attempted automatic dampers, is efficient, reliable, unharmed by temperature fluctuations in excess of those designed for, completely automatic, capable of insertion into existing conduits, low in cost, and mountable at various angles of inclination.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 1 is a perspective view of an automatic temperature responsive damper assembly in accordance with the present invention;

FIG. 2 is a sectional view taken along line 2—2 of FIG. 1;

FIG. 3 is a perspective view illustrating the underside of the damper assembly in accordance with the present invention;

FIG. 4 is a fragmentary enlarged sectional view illustrating the motion of the drive assembly to the vanes associated with the damper assembly;

FIG. 5 is a sectional view taken along line 5—5 of FIG. 4;

FIG. 6 is a side plan view illustrating that the damper assembly may be mounted in a horizontal plane;

FIG. 7 is a side view illustrating another embodiment of the damper assembly of the present invention; and FIG. 8 is a sectional view of the embodiment in FIG. 7.

DETAILED DESCRIPTION OF THE DRAWINGS

Referring to the drawings, and initially to FIGS. 1 through 6, there is illustrated a preferred embodiment of the automatic temperature responsive damper assembly 10 that may be mounted in various positions between the vertical and horizontal plane. Although the assembly 10 is normally mounted at a slight angle of inclination coinciding with the pitch of a roof in a home, there are many instances where it might be desirable to mount one or more assemblies 10 in a horizontal plane with respect to a building structure 12 having one or more enclosed areas 14 therein from which one desires to obtain venting.

The damper assembly 10 is associated with a conduit 15, which may be of circular or other configuration, and having spaced apart ends 16 and 18. The conduit 15 may form part of a ventilating system having a flanged member 20 for securement to the wall or roof structure 22, as illustrated in FIG. 6. The conduit 15 may have a mesh or other type screen 24 associated therewith and extending upwardly from conduit 15 and having a cover or hood 25 mounted at one end thereof. The hood 25 normally prevents rain from entering the conduit 15.

The damper assembly 10 forms part of a ventilating system designed to exhaust the air in a confined space 14 to the atmosphere in order to minimize excess heat buildup in the confined space. At the same time, the assembly 10 is capable of closing automatically to prevent heat loss from the confined space 14 when the weather so dictates, generally in the winter months.

The assembly 10 is formed having vane means 26, which is comprised of at least one vane, and preferably a pair of vanes 27 and 28. Each of the vanes 27 and 28 preferably has an inner edge 30 extending in substantially parallel spaced relationship to each other and an outer edge 32. The outer edge 32 of each vane is in substantially conforming relationship to the inner circumference or curvature 34 of conduit 15. In this manner, in the closed position of the vanes 27 and 28, as illustrated in FIG. 2, there will be a minimum spacing therebetween to always permit a certain amount of air flow to take place. The vanes 27 and 28 may be fabricated from metal or plastic material.

In order to permit movement of the vanes 27 and 28 about a substantially common axis lying in a plane transverse to the axis of the conduit 15, there is provided mounting means 35 operatively associated with the vanes 27 and 28. This permits movement of the vanes between a generally open position, as illustrated in FIG. 3, to a generally closed position, as illustrated in FIG. 2. The mounting means may include a shaft 36 extending transversely across the conduit 15 and having each end thereof coupled to vanes 27 and 28 in a conventional manner.

Camming means 38 is utilized in conjunction with the vanes 27 and 28 and may be formed as part of the mounting means 35. The camming means 38 may include a camming member 40 mounted on each of the vanes 27 and 28. Each camming member 40 may have a camming surface 42 that is inclined at an angle with respect to the centrally extending longitudinal vertical axis 44 of the assembly 10. The inclined camming surface 42 preferably extend in oppositely inclined orientation to each other so as to cause the vanes 27 and 28 to be angularly disposed in opposite inclination to each other.

As illustrated in FIG. 3, the respective ends of shaft 36 have associated therewith a bracket 45 that has a flange 46 secured to each vane 27 and 28. The bracket 45 has a lip 48 adapted to receive the free end of shaft 36 therein. In this manner by having each camming member 40 secured in a conventional manner to the respective vanes 27 and 28, and each camming member 40 having an aperture therethrough for receiving the shaft 36, then angular displacement around shaft 36 can be obtained by the vanes 27 and 28.

The thermal power source utilized in the assembly 10 is a temperature responsive drive assembly 50 mounted to detect temperature changes in the conduit 15 and adapted to actuate to temperature changes within a predetermined range. In the preferred embodiment shown, drive assembly 50 comprises a sealed bellows power drive unit 52 of conventional design. The unit is filled with a heat expansible fluid, the volatility of which is matched along with the shell thickness, type of metal and volume of the unit, to provide a suitable expansion at the desired temperature range. In addition to being actuated suitable at the appropriate design temperatures, the power drive assembly of the present invention should also be capable of generating a force in the range of about 50–60 pounds per square inch in order to be operable to move the damper vanes. It will be understood that any of a number of temperature-sensitive power drive units may be utilized in assembly 50 so long as their expansion and contraction characteristics are predictable and the force generated is suitable over the desired temperature range.

Accordingly, the fluid containing bellows unit 52 is capable of expanding and contracting in response to temperature changes between predetermined limits and to generate a force upon expansion. The drive assembly 50 comprises a pair of oppositely disposed plates, referred to as a top plate 54 and a bottom plate 55. Retaining means 56, which may be in the form of threaded fasteners, may extend between the plates for maintaining them in fixed spaced relationship to each other. The bellows unit 52 has one end 58 fixedly connected to the bottom plate 55 such that the opposite end 60 of the bellows unit 52 is free for moving towards and away from the vanes 27 and 28.

In order to transmit the movement between the drive assembly 50 to the camming means 38, there is provided transmission means 62. The transmission means 62 communicates the movement of the drive assembly 50 to each of the camming means 38, such that the vanes 27 and 28 are moved to varying positions in response to temperature changes in the ventilating conduit 15 as a result of the temperature in the confined space 14. It is appreciated that one or more assemblies 10 may be utilized for a confined space 14 of a given size.

The transmission means comprises a transmission housing 64 that may be in the form of a shaft. The transmission housing 64 is mounted in fixed relationship within the conduit 15 and having a lower end 65 secured to the drive assembly 50. The transmission housing 64 is mounted in fixed relationship to the conduit 15 by the mounting means 35. The mounting means 35 includes the shaft 36 extending transversely through the transmission housing 64 and the camming members 40. The retaining means 58 may be fabricated from plastic so as to snap when subjected to a temperature of about 250° F. This releases the bellows unit 52 which in turn automatically closes the vanes 27 and 28.

In operative relationship to the transmission means 62 there is provided biasing means 68 for urging the camming members 40 into contact with the transmission means 62 in a direction opposite to the forces applied by the drive assembly 50. This biasing force is utilized to obtain an automatic closing of the vanes 27 and 28 irrespective of the mounted position of the conduit 15. The biasing means is associated with the upper end 70 of the transmission housing 64. The biasing means may include a bracket member 72 mounted in fixed relationship to the transmission means 62 on the side of the vanes 27 and 28 opposite to the drive assembly 50. The bracket member 72 may extend across the conduit 15 and have end panels 74, as illustrated in FIG. 2, that are secured as by fasteners 75 to the conduit 15.

The upper end 70 of the transmission housing 64 may extend through an aperture 76 and secured in place by a washer 78 and a threaded member or nut 80. In this manner, the transmission housing 64 may extend downwardly from the bracket member 72. A spring or other resilient member 82 is mounted intermediate the bracket member 72 and the vanes 27 and 28, such that the spring 82 normally urges the vanes 27 and 28 to remain in their closed position.

To provide for the transmission of the static force, a collar 84 may be mounted coaxially on the transmission housing 64 below one end of spring 82. As illustrated in FIG. 4, when spring 82 is in its extended position, the vanes 27 and 28 would be closed and the bellows unit 52 is in its collapsed or retracted position. Expansion of the bellows unit 52 will overcome the downward force of spring 82 and permit movement of the vanes 27 and 28 to an inclined position, as illustrated by the broken lines in FIG. 4.

The lower end 65 is secured to the top plate 54 which may have an aperture 85 extending therethrough which receives the lower end 65. Connecting means 86, such as a snap ring, is utilized for coupling the lower end 65 of the transmission housing 64 to the top plate 54, such that the free end 60 of the bellows 52 is in longitudinal alignment with the transmission housing 64. This type of mounting arrangement may also permit the transmission housing 64 to be freely rotatable relative to the conduit 15.

To permit the longitudinal displacement of free end 60 to be transmitted to the camming means 38, there is provided a transmission member 88 extending within a vertically extending channel 90. The channel 90 extends inwardly from the lower end 65 of the transmission housing 64. The transmission member 88 is adapted for reciprocal movement within the confines of channel 90 in response to expansion and contraction of the free end 60 of the bellows unit 52.

The transmission member 88 may include a ledge 92 extending outwardly therefrom at one end of the transmission member 88 and a distal end 94 that engages the free end 60 of the bellows unit 52. The distal end 94 is preferably rounded to essentially make point contact with the free end 60 of the bellows 52, as illustrated in FIG. 5. A coupling member 95 is positioned on the ledge 92 for engagement by the camming surface 42 on each of the camming members 40.

The ledge 92 may be formed from a pair of outwardly extending arms 96 that may be integrally formed with the transmission member 88 and the coupling member 95 is supported by the arms 96 with a washer 98, which may be interposed therebetween. The coupling member 95 may be in the form of a disc extending coaxially on the transmission housing 64. The coupling member 95 has a coupling surface 100 which is selected to have a sufficient cross-section in order to simultaneously engage each of the camming surfaces 42 for slidably contacting same.

The drive assembly 50 is so positioned that vanes 27 and 28 are substantially horizontal when in their closed position. Transmission member 88 is adjusted to allow the vanes 27 and 28 to close completely at the low end of the temperature range. As the ambient air temperature starts to rise through the preselected range, bellows assembly 52 expands, thereby forcing transmission member 88 upward, as shown in FIG. 4. This results in the movement of the vanes 27 and 28 in the direction of arrows 104. This direction is preferably opposite to each other, but may be the same.

The upward movement of transmission member 88 causes the coupling member 95 to engage the surfaces 42 of the cam members 40, thereby causing angular rotation of each cam member 42. This angular rotation forcing pivotal movement in the vanes 27 and 28 as the cam members 42 rotate around shaft 36. This rotation continues until a maximum temperature is reached and the full expansion of the bellows unit 52 takes place.

The biasing means 68 is continuously opposing this movement by the force applied by spring 82. This force is not intended to prevent the upward movement or displacement of the coupling member 95. As the ambient temperature decreases, bellows unit 52 contracts, thus causing the free end 60 to lower and hence lowering the transmission member 88 and in turn vanes 27 and 28. Any tendency of the vanes 27 and 28 to stick in the open position is prevented by the biasing means 68 providing its continuous force. The vanes 27 and 28 continue to lower to their horizontal closed position. As will be noted, the distal end 94 of transmission member 88 need not be mechanically coupled to the bellows unit 52. In this manner the bellows unit is free to return to its collapsed position.

In view of the fact that the biasing means 68 continually applies a force, there is always an automatic closing of the vanes 27 and 28 irrespective of the mounted angular position of the conduit 15. This is most important in that it permits installation of the assembly 10 in various locations without limiting the exact location thereof. This feature permits utilization of the assembly 10 in a horizontal plane, as illustrated in FIG. 6, or in any number of angularly disposed positions and still be assured that the assembly 10 will always properly function to perform its intended purpose.

Accordingly, the damper assembly 10 illustrated in FIGS. 1–6 may be utilized on attics that require maximum venting to eliminate the tremendous heat build-up which can damage the roof and overwork an air conditioning unit during the summer season. During the winter season the damper assembly 10 aids in disposing of dampness in an attic, while keeping heat in the attic, which makes less of a demand on the heating system and results in a savings of fuel.

FIGS. 7 and 8 illustrate an alternate embodiment of the present invention in which the damper assembly **10*a* would be mounted on a building structure 12*a* which may be a roof, in which the enclosed area 14*a* is an attic. The damper assembly 10*a* includes turbine means 110*a* which are mounted on the transmission means 62*a* at one end thereof and adapted to be rotated by wind power. The turbine means 110*a* may include a sleeve or conduit 112*a* through which the upper end 70*a* of the transmission housing 64*a* extends. A pair of wind scoops or blades 114*a* are mounted at opposite ends of the turbine rotor 115*a***.

The wind is capable of engaging the wind scoops **114*a* and causing rotation in the direction of arrow 116*a* as illustrated in FIG. 8. When the vanes 27*a* and 28*a* open in the manner described above, they are capable of creating in effect a vacuum force to effectuate an air flow in the direction of arrows 118*a*, as illustrated in FIG. 7. This flow results in movement of the air confined within space 14*a* to the exterior of the dwelling through screen 24*a***.

To permit angular rotation of the transmission housing **64*a* within the conduit 112*a*, the conduit 112*a* may be secured at one end thereof to the bracket member 72*a* by means of a threaded element 120*a*. To prevent vertical displacement of the housing means 64*a* relative to the sleeve 112*a*, a seat 122*a* may be provided. A ring or other element 124*a* extends within the seat 122*a* to prevent vertical displacement. A washer or element 125*a* may be interposed between bracket member 72*a* and the spring 82*a*. In all other respects the damper assembly may operate in the same manner as previously described with respect to FIGS. 1–6**.

Therefore, in the embodiment as illustrated in FIGS. 7 and 8, a turbine type of automatic damper **10*a* is disclosed that utilizes wind power to create the pumping force required. No electrical energy is utilized. If the vanes 27*a* and 28*a* are in their closed position, then the turbine means 110*a* would still be free to rotate but substantially no air movement would take place since the vanes would rotate in their closed position. By this novel arrangement air will be expelled from the confined space 14*a* only at such time that the damper vanes are in their fully open or partially open position. Thereby permitting the homeowner to be assured that the damper assembly 10*a*** will automatically operate when required since it is automatically actuated and controlled.

Accordingly, by providing the retaining means to be self-destructive at a temperature associated with fire, the venting, or causing of an upward draft to feed a fire in the confined space or building, is avoided by automatic closing of the vanes. This is a safety feature novel to the present invention.

Although illustrative embodiments of the invention have been described in detail herein with reference to the accompanying drawings, it is to be understood that the invention is not limited to the precise embodiments, and that various changes and modifications may be effected therein without departing from the scope or spirit of the invention.

What is claimed is:

1. An automatic temperature responsive damper assembly for use within the conduit of a ventilating system designed to exhaust the air in a confined space to the atmosphere whereby said conduit may be opened in order to minimize excess heat build up in said confined space and closed when it is desired to prevent heat loss from said confined space, said assembly comprising:

A. at least one vane carried within said conduit,

B. mounting means operatively associated with said conduit for pivotally securing said at least one vane thereto, so as to be movable between a generally open position and a generally closed position in said conduit, C. camming means secured to said at least one vane carried by said mounting means and including a camming surface thereon, D. a temperature responsive drive assembly mounted to detect temperature changes in said conduit and adapted to actuate in response to temperature changes within a predetermined range, E. transmission means operatively extending between said drive assembly and said camming surface of said camming means for communicating movement of said drive assembly to said camming means, such that said at least one vane is moved to varying positions in response to temperature changes in said ventilating conduit, and F. biasing means for urging said camming means into contact with said transmission means in a direction opposite to the forces applied by said drive assembly, so as to obtain an automatic closing of said at least one vane irrespective of the mounted position of said conduit.

2. The apparatus as defined in claim 1, wherein said drive assembly comprises:

a. a pair of oppositely disposed top and bottom plates, b. means for retaining said plates in spacially fixed position relative to each other, c. a fluid containing bellows unit capable of expanding and contracting in response to temperature changes between predetermined limits and to generate a force upon expansion, and d. said bellows having one end connected to said bottom plate such that the opposite end thereof is free for moving towards and away from said transmission means.

3. The apparatus as defined in claim 2, wherein said transmission means comprises:

a. a transmission housing mounted in fixed relation within said conduit and having a lower end secured to said drive assembly, b. a vertically extending channel in said transmission housing extending inwardly from said lower end, and c. a transmission member adapted for reciprocal movement within said channel in response to expansion and contraction of said bellows resulting in movement of said free end thereof.

4. The apparatus as defined in claim 3, wherein said transmission member includes:

a. a ledge extending outwardly therefrom, and b. a coupling member positioned on said ledge for engagement with said camming surface.

5. The apparatus as defined in claim 4, wherein said transmission member includes a distal end that engages said free end of said bellows.

6. The apparatus as defined in claim 4, wherein said distal end is rounded to essentially make point contact with said free end of said bellows.

7. The apparatus as defined in claim 4, wherein a. said transmission housing is mounted in fixed relationship to said conduit by said mounting means, and b. said mounting means includes a shaft extending transversely through said transmission housing and said camming means.

8. The apparatus as defined in claim 4, wherein a. said top plate of said drive assembly has an aperture extending therethrough, b. said lower end of said transmission housing extends through said aperture so as to extend between said plates, and c. means for connecting said lower end of said transmission housing to said top plate, such that said channel is in longitudinal alignment with said free end or said bellows.

9. The apparatus as defined in claim 4, wherein a. said ledge is formed by a pair of arms extending outwardly from said transmission member, and b. said coupling member is supported by said arms.

10. The apparatus as defined in claim 9, wherein said coupling member is in the form of a disc extending coaxially on said transmission housing.

11. The apparatus as defined in claim 4, wherein said at least one vane comprises a pair of pivoted split vanes movable about a substantially common axis, said axis lying in a plane transverse to the axis of said conduit.

12. The apparatus as defined in claim 11, wherein a. said vanes each have an inner edge and an outer edge, b. said inner edges extending in substantially parallel spaced relationship to each other, and c. said outer edges substantially conforming to the circumference of said conduit.

13. The apparatus as defined in claim 11, wherein said camming means includes a camming member mounted on each of said vanes and having a camming surface for slidably contacting said coupling member.

14. The apparatus as defined in claim 13, wherein said camming surfaces on each of said vanes extend in oppositely inclined orientation to each other so as to cause said vanes to be angularly disposed in opposite inclination to each other.

15. The apparatus as defined in claim 1, wherein said biasing means comprises:

a. a bracket member mounted in fixed relation to said transmission means on the side of said at least one vane opposite to said drive assembly, and b. a spring mounted in telescopic relationship to said transmission means intermediate said bracket member and said at least one vane, such that said spring normally urges said at least one vane to remain in its closed position.

16. The apparatus as defined in claim 15, wherein said bracket is coupled at each end thereof to said conduit.

17. The apparatus as defined in claim 15, including a collar mounted coaxially on said transmission means, on the side of said at least one vane opposite to said drive assembly and below said spring.

18. The apparatus as defined in claim 1, wherein said transmission means is rotatably mounted with respect to said conduit.

19. The apparatus as defined in claim 18, including turbine means mounted on said transmission means at one end thereof and adapted to be rotated by wind power.

20. An automatic temperature responsive damper assembly for use within the conduit of a ventilating system designed to exhaust the air in a confined space to the atmosphere whereby said conduit may be opened in order to minimize excess heat build up in said confined space and closed when it is desired to prevent heat loss from said confined space, said assembly comprising:

A. a pair of vanes carried within said conduit,

B. mounting means operatively associated with said conduit for pivotally securing said vanes thereto, so as to be movable between a generally open position and a generally closed position in said conduit, C. camming means secured to each one of said vanes carried by said mounting means and including a camming surface thereon, D. a temperature responsive drive assembly mounted to detect temperature changes in said conduit and adapted to actuate in response to temperature changes within a predetermined range, E. said drive assembly comprises:

(i) a pair of oppositely disposed top and bottom plates, (ii) retaining means for joining said plates in spacially fixed position relative to each other, (iii) a fluid containing bellows unit capable of expanding and contracting in response to temperature changes between predetermined limits and to generate a force upon expansion, and (iv) said bellows having one end connected to said bottom plate such that the opposite end thereof is free for moving towards and away from said vanes, F. transmission means operatively extending between said drive assembly and said camming surface of each one of said camming means for communicating movement of said drive assembly to each of said camming means, such that said vanes are moved to varying positions in response to temperature changes in said ventilating conduit, G. said transmission means comprises:

(v) a transmission housing mounted in fixed relation within said conduit and having a lower end secured to said drive assembly, (vi) a vertically extending channel in said transmission housing extending inwardly from said lower end, and (vii) a transmission member adapted for reciprocal movement within said channel in response to expansion and contraction of said free end of said bellows, H. biasing means for urging each of said camming means into contact with said transmission means in a direction opposite to the forces applied by said drive assembly, so as to obtain an automatic closing of said vanes irrespective of the mounted position of said conduit, and I. said biasing means comprises:

(viii) a bracket member mounted in fixed relation to said transmission means on the side of said vanes opposite to said drive assembly, and (ix) a spring mounted intermediate said bracket member and said vanes, such that said spring normally urges said vanes to remain in their closed position.

21. The apparatus as defined in claim 20, wherein said transmission member includes:

a. a ledge extending outwardly therefrom, and b. a coupling member positioned on said ledge for engagement with said camming surface on each one of said camming means.

22. The apparatus as defined in claim 21, wherein said transmission member includes a distal end that engages said free end of said bellows.

23. The apparatus as defined in claim 22, wherein said distal end is rounded to essentially make point contact with said free end of said bellows.

24. The apparatus as defined in claim 20, wherein a. said transmission housing is mounted in fixed relationship to said conduit by said mounting means, b. said mounting means includes a shaft extending transversely through said transmission housing and said camming means, c. said top plate of said drive assembly has an aperture extending therethrough, d. said lower end of said transmission housing extends through said aperture so as to extend between said plates, and e. means for connecting said lower end of said transmission housing to said top plate, such that said channel is in longitudinal alignment with said free end of said bellows.

25. The apparatus as defined in claim 21, wherein a. said ledge is formed by a pair of arms extending outwardly from said transmission member, b. said coupling member is supported by said arms, and c. said coupling member is in the form of a disc extending coaxially on said transmission housing.

26. The apparatus as defined in claim 25, wherein a. said vanes comprised are movable about a substantially common axis, said axis lying in a plane transverse to the axis of said conduit, b. said vanes each have an inner edge and an outer edge, c. said inner edges extending in substantially parallel spaced relationship to each other, and d. said outer edges substantially conforming to the inner circumference of said conduit.

27. The apparatus as defined in claim 26, wherein said camming means includes a camming member mounted on each of said vanes and having a camming surface for slidably contacting said coupling member.

28. The apparatus as defined in claim 27, wherein said camming surfaces on each of said vanes extend in oppositely inclined orientation to each other so as to cause said vanes to be angularly disposed in opposite inclination to each other.

29. The apparatus as defined in claim 20, wherein said bracket member is coupled at each end thereof to said conduit.

30. The apparatus as defined in claim 20, including a collar mounted coaxially on said transmission means, on the side of said vanes opposite to said drive assembly and below said spring.

31. The apparatus as defined in claim 20, wherein said transmission means is rotatably mounted with respect to said conduit.

32. The apparatus as defined in claim 31, including turbine means mounted on said transmission means at one end thereof and adapted to be rotated by wind power.

33. The apparatus as defined in claim 32, including a hood mounted over said conduit to enclose same, and said transmission means extends through said hood.

34. The apparatus as defined in claim 20, wherein said retaining means automatically releases said drive assembly from its operative position with said vanes when subjected to certain temperatures so as to obtain a closing thereof such that an upward draft to the atmosphere is avoided.

35. The apparatus as defined in claim 34, wherein said retaining means is fabricated from plastic and melts at a temperature of about 250° F.

* * * * *